US005131336A

United States Patent [19]

Kono et al.

[11] Patent Number: 5,131,336

[45] Date of Patent: Jul. 21, 1992

[54] WAIST PART CLOTH GUIDING DEVICE FOR A SEWING MACHINE

[75] Inventors: Toshitaka Kono, Suita; Toshihito Negoro, Osaka; Masahiko Nishikawa, Suita, all of Japan

[73] Assignee: Pegasus Sewing Machine Mfg. Co., Ltd., Osaka, Japan

[21] Appl. No.: 696,739

[22] Filed: May 7, 1991

[30] Foreign Application Priority Data

May 18, 1990 [JP] Japan ..... 2-129921

[51] Int. Cl.[5] ..... D05B 35/04; D05B 35/06

[52] U.S. Cl. ..... 112/121.26; 112/121.27; 112/141; 112/147

[58] Field of Search ..... 112/121.26, 121.27, 112/305, 304, 141, 147, 121.15, 322, 318, 2, 63, 10, 143

[56] References Cited

U.S. PATENT DOCUMENTS

| | | | |
|---|---|---|---|
| 4,037,547 | 7/1977 | Marforio | 112/121.27 |
| 4,185,570 | 1/1980 | Kleinschmidt et al. | 112/121.27 X |
| 4,665,848 | 5/1987 | Michaels et al. | 112/121.26 |
| 4,860,676 | 8/1989 | Kawai et al. | 112/121.26 X |

*Primary Examiner*—Peter Nerbun

*Attorney, Agent, or Firm*—Jones, Tullar & Cooper

[57] ABSTRACT

A waist part cloth guiding device for a sewing machine comprises a guide which folds and guides a side edge portion of a cylindrical cloth to enclose a ring band ahead of the needle drop point, while feeding the band together with the cloth in a cloth feed direction by a forced feeding device, regardless of the operation of a main shaft of the sewing machine. After setting the ring band to be inserted into the folded portion of the cylindrical cloth at a position close to the needle drop point of the sewing machine, the side edge portion of the cylindrical cloth may be automatically guided and folded to the lower side of the ring band.

16 Claims, 10 Drawing Sheets

WAIST PART CLOTH GUIDING DEVICE FOR A SEWING MACHINE

BACKGROUND OF THE INVENTION

1. Field of the Invention

The present invention relates to a waist part cloth guiding device for a sewing machine preferably employed in sewing a folded edge of cylindrical cloth for a waist of under wear such as a brief and inserting a ring-shaped elastic band inside of the folded edge.

2. Prior Art

Hitherto, the following method was employed to make a waist portion of the brief or the like.

First, the elastic waistband is set in a position to pass close to a needle drop point of a sewing machine, having the peripheral direction of the waistband matched with the cloth feeding direction of the sewing machine. Next, a cylindrical cloth is placed on the waistband, and a side end portion of the cloth is folded down by hand beneath the waistband by a necessary width, and sewing by the sewing machine is started. After starting sewing, holding the cloth by hand before the needle drop point, by maintaining a hand in a suitable position, the cloth is guided so that the waistband is sequentially rolled in by the side portion of the cloth being fed out of the needle drop point along with the sewing process, thereby inserting the waistband into the waist portion of the brief.

Such conventional sewing method required manual handling in all steps of setting the cloth in the specified position, folding the side portion beneath the band, and rolling the waistband into the folded portion of the cloth after start of sewing, the job efficiency was poor, and it required skill, and hence the product quality tended to be inconsistent.

SUMMARY OF THE INVENTION

In the light of the above problems, it is hence the primary object of the invention to provide a waist part cloth guiding device for a sewing machine capable of securely folding an edge of a cylindrical cloth automatically before starting the sewing machine by a simple prior job of only moving the cloth in a cloth feed direction after setting the cloth on a specified position.

Another object of the invention is to provide a device for inserting an elastic ring band automatically into a folded edge of the cylindrical cloth before starting the sewing machine by a simple prior job of only moving the ring band in the cloth feed direction after setting the cloth on the ring band set in a specified position.

It is another object of the invention to provide a waist part cloth guiding device for a sewing machine in which the side portion of the cloth can be introduced smoothly beneath the band.

It is a different object of the invention to obtain a product free from failure of sewing by preventing the curling of the edge portion of the folding part being folded beneath the ring band in the said device.

It is a further different object of the invention to be capable of sending out automatically the cloth in the cloth feeding direction regardless of the operation of the main shaft of the sewing machine, only by setting the cloth in a specified position.

To achieve the primary object, the first invention presents a waist part cloth guiding device for a sewing machine which comprises:

a band setting part capable of setting a ring band at a position passing close to a needle drop point of the sewing machine with a peripheral direction of the ring band matched in a cloth feeding direction of the sewing machine, and being movable in the cloth feeding direction, a forced feeding device for feeding the ring band set on the band setting part, in the cloth feeding direction regardless of the operation of the main shaft of the sewing machine, together with a cloth to be sewn folded at its side portion before sewing, and a side portion folding guide disposed before the needle drop point for folding the side portion of the cloth overlaid on the ring band on the throat plate and for guiding said portion beneath the ring band.

According to this first embodiment, by operating the forced feeding device after setting the ring band on the band setting part, the side portion of the cloth may be folded down under the lower side of the band automatically at the needle drop point. Therefore, as compared with the prior art, the job efficiency may be notably improved, while products of uniform quality may be obtained regardless of the skill of the operators.

The second embodiment relates to the first embodiment, in which the side portion folding guide comprises:

first guide plane which abuts against the inner circumference of the ring band set on the band setting part, second guide plane having a front end part located further inside of an inside end side parallel to the cloth feeding direction of the first guide plane, and an upper side which intersects with the inside end side of the first guide plane beneath the first guide plane and is inclined downward and inward, and third guide plane, having a U-shaped cut section shape in a the direction orthogonal to the cloth feeding direction, which encloses the inside end side of the first guide plane at an action position rearward in the cloth feeding direction to a position where the upper side of the second guide plane intersects with the inside end side of the first guide plane, and the third guide plane being movable between this action position and a waiting position not enclosing the inside end side.

According to the second embodiment, the side end portion of the cloth fed by the forced feeding device may be guided beneath the first guide plane by the second and third guide planes of the side end portion folding guide. Thus, by mutual actions of the first to third guide planes, the side end portion of the cloth may be smoothly led into the back side of the ring band.

The third embodiment is a different waist part cloth guiding device for a sewing machine in which, in the middle between the third guide plane of the cloth side folding guide and the needle drop point, there is provided a cloth guide capable of moving between the action position for guiding the cloth along the inside end edge of the ring band set in the band setting part and the waiting position retreating inward from this action position. According to the third embodiment, by the cloth guide disposed in the middle between the third guide plane and the needle drop point, the folding part of the cloth guided downward from the first guide plane of the cloth side end folding part is guided without being dislocated from the lower side of the band, and the side portion of the cloth may be securely fitted to the back side of the ring band.

The fourth embodiment provides another waist part cloth guiding device for a sewing machine in which at the position along the third guide plane of the cloth side portion folding guide, there is disposed a nozzle for blowing air to the edge of the folding part guided beneath the first guide plane by the second guide plane and the third guide plane. According to the fourth embodiment, by blowing air to the folding portion edge from the nozzle disposed along the third guide plane, curling of the edge of the folding portion may be removed to flat state, so that products of high quality free from failure of sewing may be obtained.

In other devices, according to the fifth and sixth embodiments, the band setting part comprises plural rod guides intersecting orthogonally with the cloth feed direction for winding the ring band, and of these rod guides, at least rod guide serving also as a feed guide located behind the needle drop point is rotatable around an axis of rotation, the forced feeding device comprises a feed roller movable between the action position for holding the cloth and band with the rod guide serving also as a feed guide a and the waiting position retreating from this action position, and a driving source for rotating this feed roller, the feed roller is moved from the waiting position to the action position by a signal detecting setting of the cloth in the specified position including above the ring band passing close to the needle drop point of the sewing machine, while the feed roller is moved from the action position to the waiting position depending on the sewing command to the sewing machine. According thus composed fifth and sixth embodiments, by disposing the cloth on the band after setting the band on the band setting part, the feed roller of the forced feeding device automatically holds the cloth and band with the rod guide serving also as feed guide of the band setting part, and this holding is canceled when a sewing command is issued to the sewing machine. Therefore, only by setting the cloth in specified position, folding job may be started immediately, so that the working efficiency may be further enhanced.

In other different devices according to the seventh and eighth embodiments, the third guide plane of the cloth side portion folding guide moves from the waiting position to the action position by the driving command to the driving source of the forced feeding device, and when it is detected that the cloth is removed from the sewing position, it moves from the action position to the waiting position. Additionally, the cloth guide moves from the waiting position to the action position according to the driving command to the driving source of the forced feeding device, and when it is detected that the cloth is removed from the sewing position, it is designed to be moved from the action position to the waiting position. According to the eighth embodiment, by positioning the third guide plane of the cloth side portion folding guide and the cloth guide at the waiting position until the driving command to the driving source of the forced feeding device is issued, the cloth may be easily set at a specified position, and the third guide plane of the side portion folding guide and the cloth guide move backward to the waiting position before the next cloth is set. Therefore, setting of both ring band and cloth is easy, and it is effective for enhancing the job efficiency.

Different devices according to the ninth and tenth embodiments comprise, in the middle between the cloth side portion folding guide and needle drop point or cloth guide, a tongue-shaped position matching guide which abuts the rear side of the ring band set in the band setting part and is movable from the action position for lifting or support it to the waiting position retreating from the action position to the outside of the sewing machine, and, when the sewing start portion approaches the nearer side after start of sewing, moves from the action position to the waiting position, and also comprises a lifting rod, in the middle between the cloth side portion folding guide and the needle drop point or cloth guide, for lifting the ring band from its back side together with the cloth when the position matching guide is moving to the waiting position. According to the ninth and tenth embodiments, the device is provided with a position matching guide and lifting rod, after start of sewing, when the sewing start position comes to the nearer side of the position matching guide, if this position matching guide is set aside to the waiting position, the ring band sent to the needle drop point may be lifted to the level of the needle drop point, together with the cloth side portion, by the lifting rod. As a result, bending of the sewing line to the side portion side due to lowering of the cloth to the inside from the sewing position, that is, side portion side of the cloth may be avoided. Hence, products of high quality matching in the sewing start part and sewing end part may be obtained.

Other objects and effects of the invention will be better understood and appreciated from the preferred embodiment described in conjunction with the accompanying drawings.

In the following description of the preferred embodiment, the band to be inserted into the folded cloth is a waistband, but the invention may be applied to other ring-shaped bands to be inserted into the folded end portion of the cloth.

The device explained in the preferred embodiment is intended to fold back the side portion of cloth to the inner side and sew and insert the ring-shaped band therein automatically, but it is also possible to be used as a device for setting only the side portion of the cylindrical cloth without setting the ring-shaped band, and folding back the side portion to sew.

DETAILED DESCRIPTION OF THE PREFERRED EMBODIMENT

Figure 1:
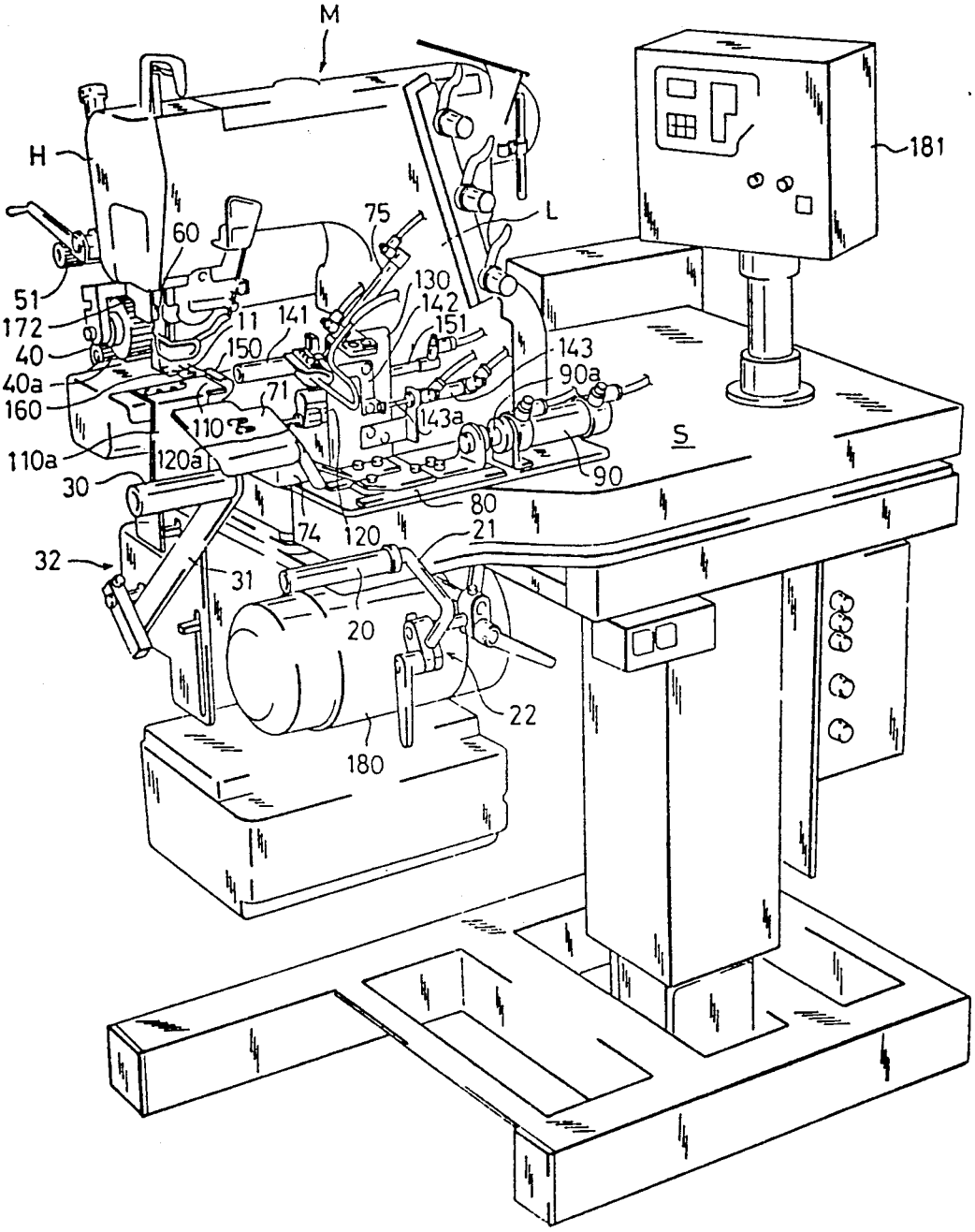
FIG. 1 is a schematic perspective view of a waist part cloth guiding device in a sewing machine as seen from the front left side.

As is clear from FIG. 1, in this embodiment, the waist part cloth guiding device is explained in a right hand sewing machine of which leg L of sewing machine main body M is at the right side of the arm head H. In the following description, the right side of this right hand sewing machine is referred to as the inside, and the left side as the outside.

Figure 2:
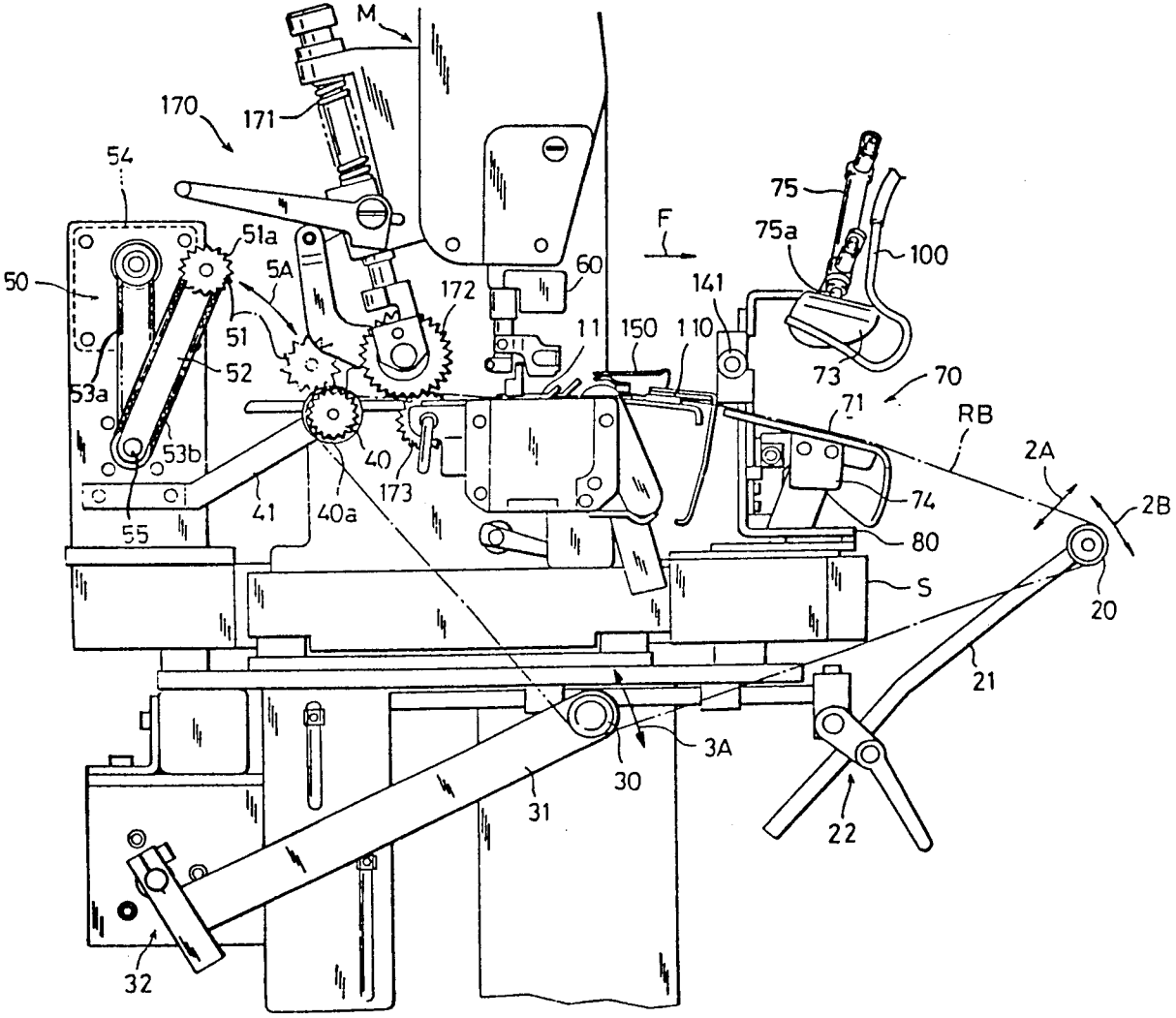
FIG. 2 is a schematic side view of FIG. 1.

As clearly illustrated in FIG. 2, ahead of a needle drop point 11 on a bed B of a sewing machine M (arrow F direction), there is disposed a guide roller 20 rotatably mounted on the front end of an arm 21, and beneath the needle drop point 11 is disposed a guide roller 30 rotatably mounted on the front end of an arm 31, and there is also a guide roller 40 rotatably mounted on the front end of an arm 41 behind the needle drop point 11. These guide rollers 20, 30, 40 possess rotary shafts orthogonal to the cloth feed direction. As clarified in FIG. 1, the arms 21, 31 are supported by position adjusting devices 22, 32, and by manipulating one position adjusting device 22, the position of the guide roller 20 may be adjusted in the directions of arrows 2A and 2B as shown in FIG. 2, and by manipulating the other position adjusting device 32, the position of the guide roller 30 may be adjusted in the direction of arrow 3A.

By applying a ring-shaped waistband RB on these three guide rollers 20, 30, 40, the waistband RB may be set in a specific position passing under the needle drop point 11 around the bed B. At this time, by adjusting the position of the guide rollers 20 and 30, the tension of the waistband RB may be adjusted to a desired degree of tension. Thus, the guide rollers 20, 30, 40 compose the band setting part for winding the waistband RB around the position to pass under the needle drop point 11, with its peripheral direction matched with the cloth feeding direction and in a state movable in the cloth feed direction. The guide roller 40 is, as mentioned later, intended to compose the rod guide serving also as feed guide, and serrated teeth 40*a* are formed on its outer circumference.

As shown in FIG. 2, a forced feeding device 50 is disposed behind in the cloth feed direction of the guide roller 40. This forced feeding device 50 is intended to move the waistband RB wound on the band setting part in the cloth feed direction regardless of the operation of the sewing machine main shaft (not shown), together with the cloth disposed thereon, by cooperating with the guide roller 40 for composing the rod guide serving also as feed guide, and it is provided with a feed roller 51 having serrated teeth 51*a* formed on the outer circumference thereof. This feed roller 51 is rotatably mounted on a top end of the arm 52, and is rotated by the torque of a rotation driving source 54 such as a motor or the like applied through belts 53*a*, 53*b*. The arm 52 can rotate about a pivot 55 by operating an air cylinder which is not shown. By the rotation of the arm 52, the feed roller 51 can move between the action position indicated by single dot chain line in FIG. 2 capable of nipping the waistband RB and cloth with the guide roller 40, and the waiting position as indicated by solid line in FIG. 2 escaping from this action position (see arrow 5A). In this embodiment, as shown in the time chart in FIG. 5, the feed roller 51 moves from the waiting position to the action position in specified time T1 after the cloth sensor 60 disposed above the needle drop point 11 detects that the cloth is set on the needle drop point 11, and then moves from the action position to the waiting position when the sewing machine switch is turned on, that is, when sewing command is issued to the sewing machine.

Between the needle drop point 11 and the guide roller 20, there is disposed a cloth side portion folding guide 70 for folding and guiding the side portion of the cloth overlaid on the waistband RB set at the band setting part, to beneath the waistband RB. This cloth side portion folding guide 70 comprises, as shown in FIG. 4A, the first guide plane 71 which abuts against the inner circumference of the waistband RB set in the band setting part, the second guide plane 72 which guides the cloth side portion below the first guide plane 71, using the inside of the first guide plane 71, that is, the right side end side 71*a* as the folding guide, and a third guide plane 73.

As shown in FIG. 2, the first guide plane 71 is made of a plate material inclined upward to the rear side and curved downward on the front side. The plate material for forming this first guide plane 71 is, as shown in FIG. 1, fixed on a sliding member 80 slidable with respect to a sewing machine mounting stand S through a mounting member 74.

Figure 4A:
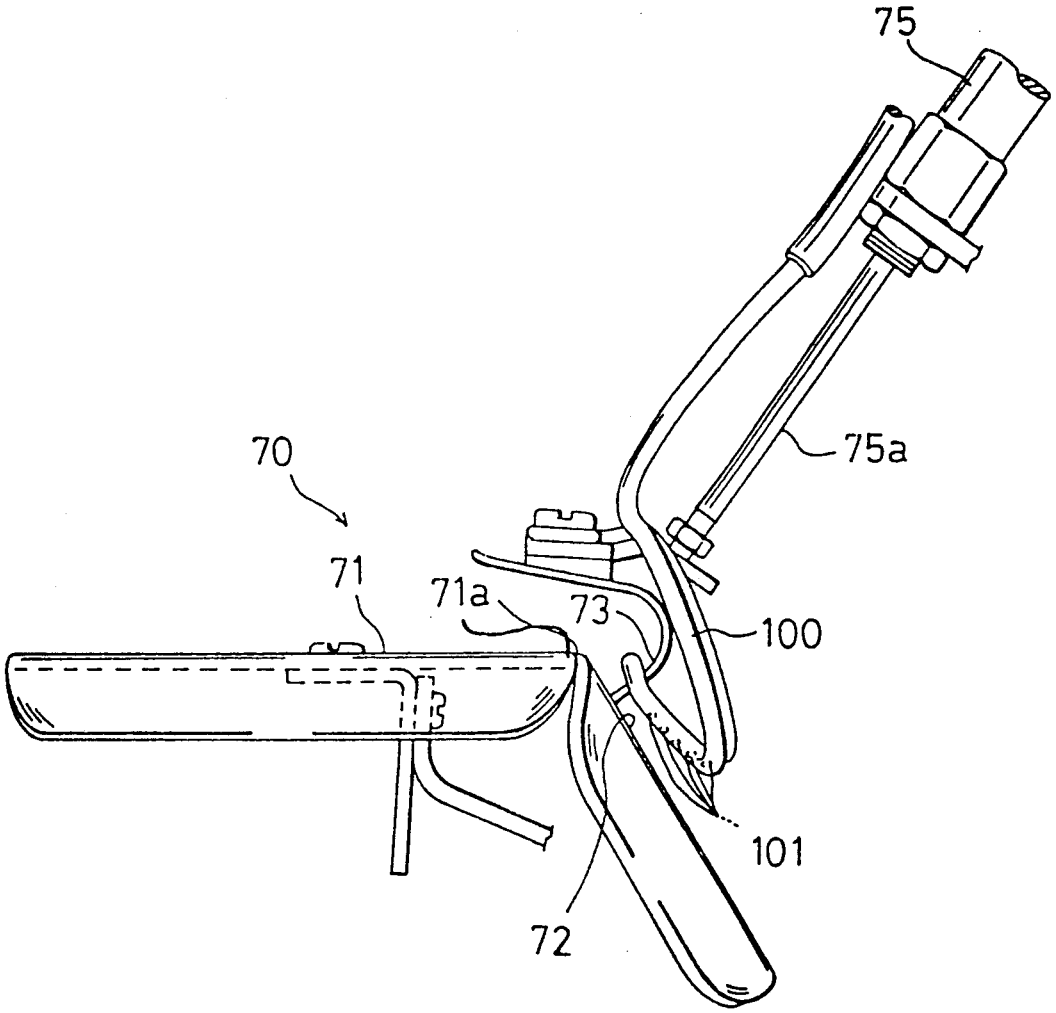
FIG. 4A is a magnified front view of a side portion folding guide.
Figure 4B:
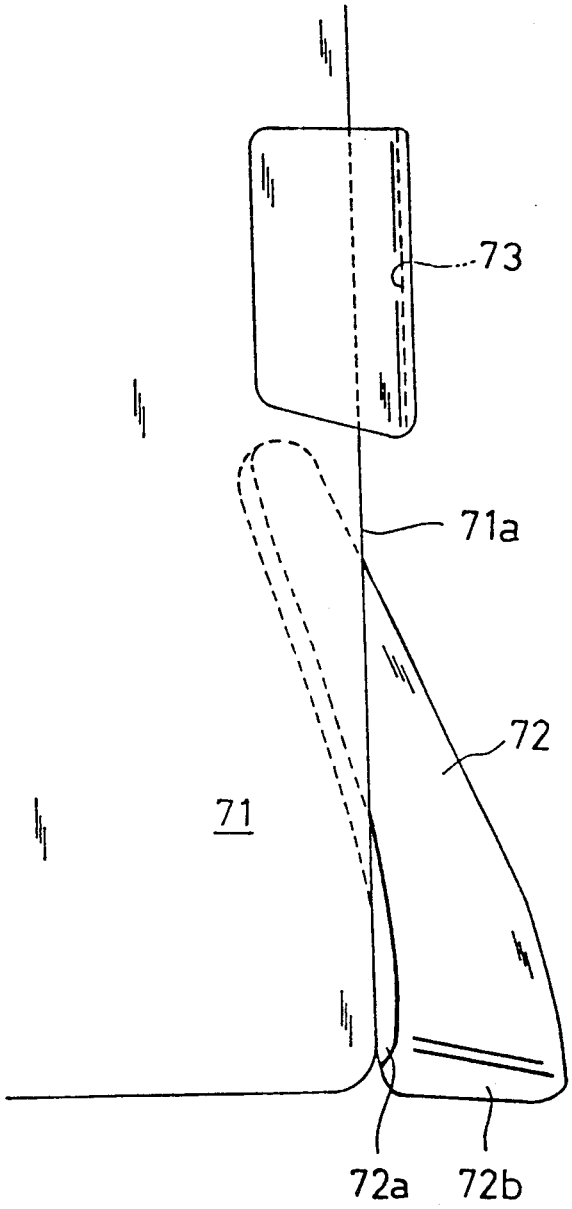
FIG. 4B is a plan view of FIG. 4A.

As shown in FIG. 4A and FIG. 4B, the second guide plane 72 is made of a plate material inclining downward to the inside, and it is integrally fixed to the first guide plane 71. The upper side of the second guide plane 72 has its front end part 72*a* further to the right side of the right side end side 71*a* of the first guide plane 71, and is crossing the right side end side 71*a* beneath the first guide plane 71. On this second guide plane 72, a cloth leading part 72*b* is curved and projects outside guide plane 71 to guide, the cloth smoothly without being caught, at the forward side of the front end side 72*a*.

As shown in FIG. 1, the sliding member 80 slides in the direction orthogonal to the cloth feed direction of the sewing machine by manipulating the air cylinder 90 fixed to the sewing machine mounting stand S. That is, by extending the piston rod 90*a* of the air cylinder 90, the sliding member 80 slides from right to left, and the first and second guide planes 71, 72 also move from right to left in unison. By this movement, the first guide plane 71 disengages the abutting position with the waistband RB set in the band setting part at the action position. As the piston rod 90*a* of the air cylinder 90 retreats, the first guide plane 71 returns to the original action position together with the second guide plane 72.

The third guide plane 73 is formed by the inner surface of a plate material having a U cut section shape in the direction orthogonal to the cloth feed direction. The plate material for forming this third guide plane 73 is coupled to a piston rod 75*a* of an air cylinder 75 fixed on the sewing machine main body M, and by manipulating the air cylinder 75, the third guide plane 73 moves between the action position and waiting position. That is, the third guide plane 73 is, by extending the piston rod 75*a*, set in the action position for positioning the right side end side 71*a* at the inside of the U-opening, behind the cloth feed direction from the position of the upper side of the second guide plane 72 crossing the right side end side 71*a* of the first guide plane 71, as shown in FIGS. 4A and 4B. By withdrawing the piston rod 75*a*, the right side end side 71*a* retreats from the action position to the waiting position at the outside of the U-opening. As the third guide plane 73 and second guide plane 72 act on each other, the necessary width of the cloth in the side portion is led beneath the first guide plane 71 as the folding allowance.

On the third guide plane 73, the front end of air feed pipe 100 connected to a compressed air source not shown herein is running along. Multiple downward nozzles 101 arranged spirally are disposed on the front end part side wall of this air feed pipe 100. These nozzles 101 are formed so as to eject air to the second guide plane 72 in the state where the third guide plane 73 is at the action position.

In the middle between the cloth side portion folding guide 70 and needle drop point 11, a tongue-shaped positioning guide 110 is set up for lifting or supporting the waistband RB passing this middle portion. The waistband RB is sent to the needle drop point 11 in correct posture by the positioning guide 110. Along the positioning guide 110, by leading the folding part of the cloth beneath, this folding part is also led into the lower side of the waistband RB in correct posture. As shown in FIG. 3E, a base end part 110*a* of this positioning guide 110 disposed at the left side of the waistband RB set at the band setting part is coupled with a piston rod 120*a* of the air cylinder 120. The air cylinder 120 is fixed to a mounting member 130 installed on the sliding member 80. Therefore, by operating the air cylinder 90, this positioning guide 110 moves in the direction orthogonal to the cloth feed direction, together with the first guide plane 71 and second guide plane 72, and by manipulating the air cylinder 120, the guide 110 moves in the direction orthogonal to the cloth feed direction, independently of the first guide plane 71 and second guide plane 72. That is, by extending the piston rod 90*a* of the air cylinder 90 and the piston rod 120*a* of the air cylinder 120, the positioning guide 110 is withdrawn from the action position for guiding the waistband RB.

Just ahead of the positioning guide 110, a band lifting rod 141 is disposed. As shown in FIG. 3A to FIG. 3E, this band lifting rod 141 has its base end part fixed to a reciprocating member 142. This reciprocating member 142 is oscillatably mounted on the mounting member 130, and is also coupled to a piston rod 143*a* of an air cylinder 143 fitted to this mounting member 130. This band lifting rod 141 moves to the back side of the waistband RB set in the band setting part by extending the piston rod 90*a* of the air cylinder 90, and by further keeping the extended state, by moving back the piston rod 143*a* of the air cylinder 143, its upper end is raised to abut against the inner circumference of the waistband RB, thereby lifting the waistband RB.

Immediately behind the action position of the positioning guide 110, there is a cloth guide 150 for guiding the cloth, disposed movably in a direction orthogonal to the cloth feeding direction. That is, this cloth guide 150 is coupled to the piston rod 151*a* of the air cylinder 151 mounted on the sewing machine main body M as shown in FIG. 3A to FIG. 3E, and by extending this piston rod 151*a*, it is possible to move from the waiting position to the action position. This cloth guide 150 is obtained by dividing a funnel shaped cylinder into two sections in the axial direction, and comprises a semicylindrical part 150*a* having the large diameter side at the foreground in the cloth feed direction, and a holder part 150*b* continuous to the rear side of this semicylindrical part 150*a*. This cloth guide 150, at the action position, brings the cloth folding part closer to the rear side of the waistband RB by the semicylindrical part 150*a*, and also guides the outside surface of the folding part of the cloth by the holder part 150*b*.

Behind the presser foot 160 of this sewing machine M, meanwhile, as shown in FIG. 2, a forced feeding device 170 for sewing is disposed. This forced feeding device 170 comprises a drive roller 172 which rotates in cooperation with the main shaft of the sewing machine. This drive roller 172 holds the cloth and waistband RB with a feed roller 173 by the thrusting force of a compressive spring 171, and sends them in the cloth feed direction by force along with driving of the sewing machine. This forced feeding device 170 moves up and down in cooperation with the presser foot 160, and in raised state, the drive roller 172 is apart from the feed roller 173.

As shown in FIG. 1, a motor 180 and control box 181 for the sewing machine M are installed on the sewing machine mounting stand S.

Figure 5:
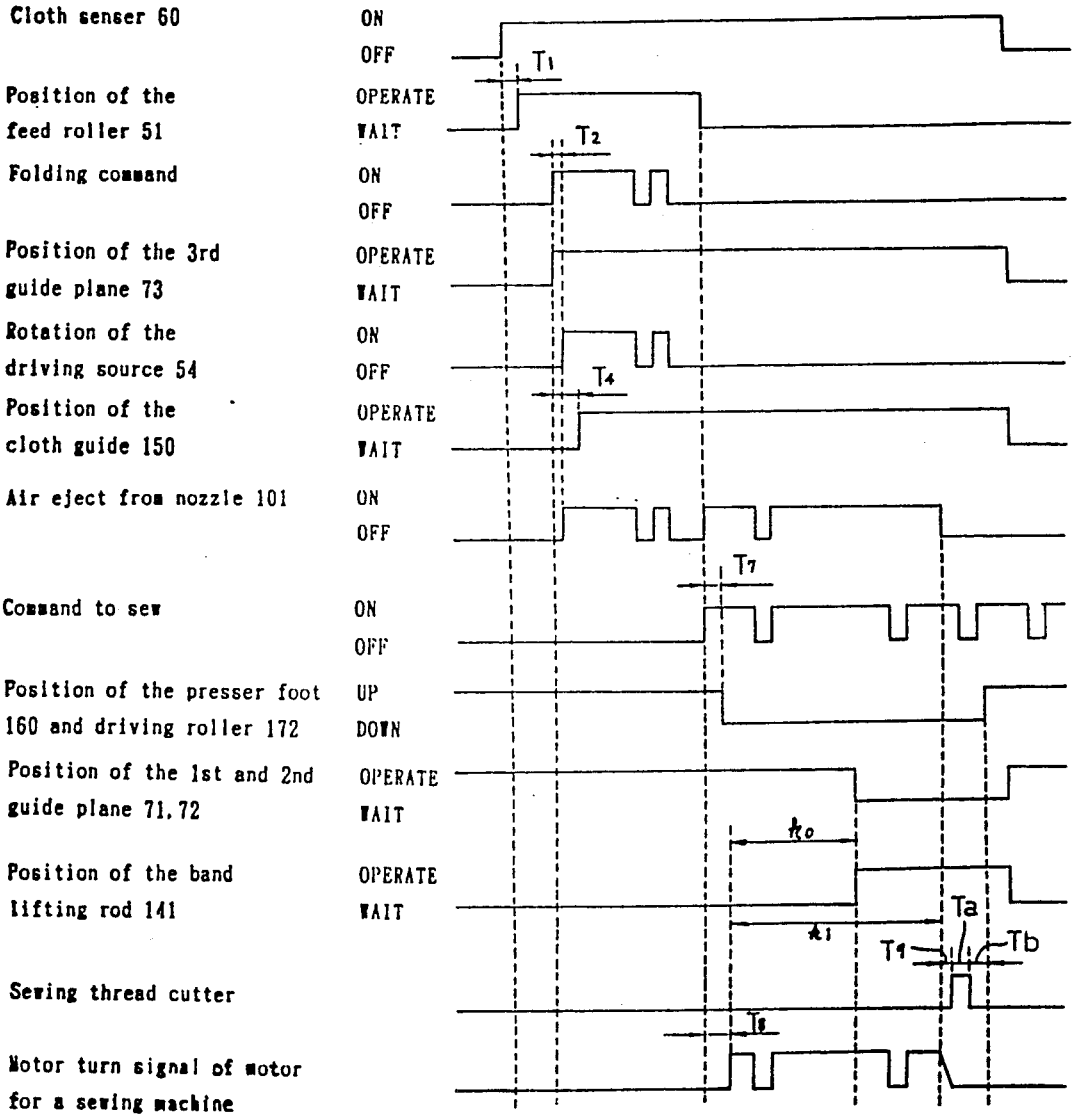
FIG. 5 is a diagram showing an example of time chart of the operating state.

The waist part cloth guiding device for a sewing machine composed in this way automatically makes a waist portion by folding and sewing an edge of the cloth and inserting the waistband in the folded portion of the cloth according to the time chart shown in FIG. 5.

Figure 3A:
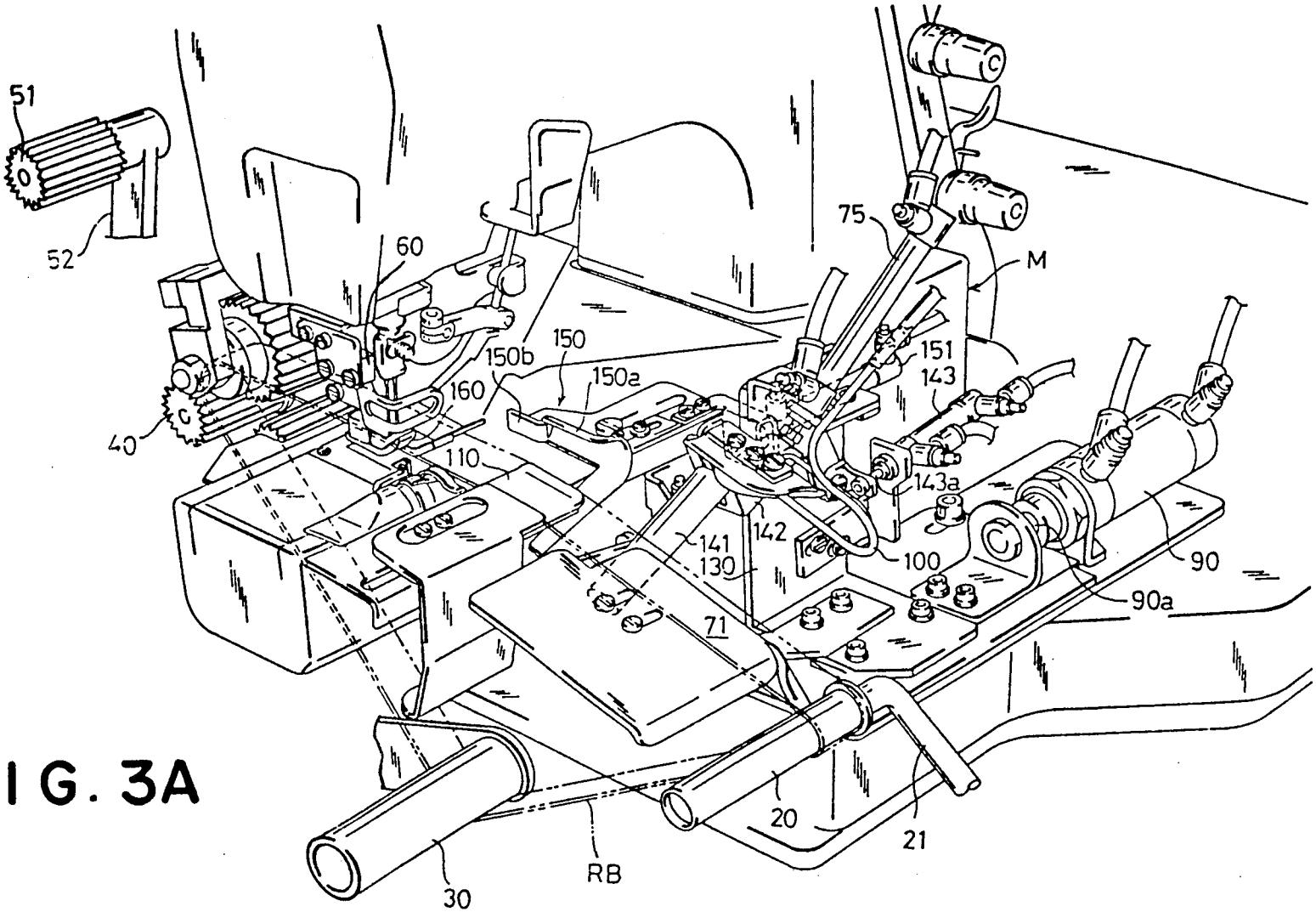
FIG. 3A through FIG. 3E are magnified perspective explanatory drawings of essential parts showing operating states.

First as shown in FIG. 3A, only the first and second guide planes 71, 72 and positioning guide 110 are set at the action position, and the waistband RB is set in the band setting part as indicated by single dot chain line. In other words, the waistband RB is wound around the guide rollers 20, 30, 40, and its inner circumference is caused to abut against the first guide plane 71 and positioning guide 110.

Figure 3B:
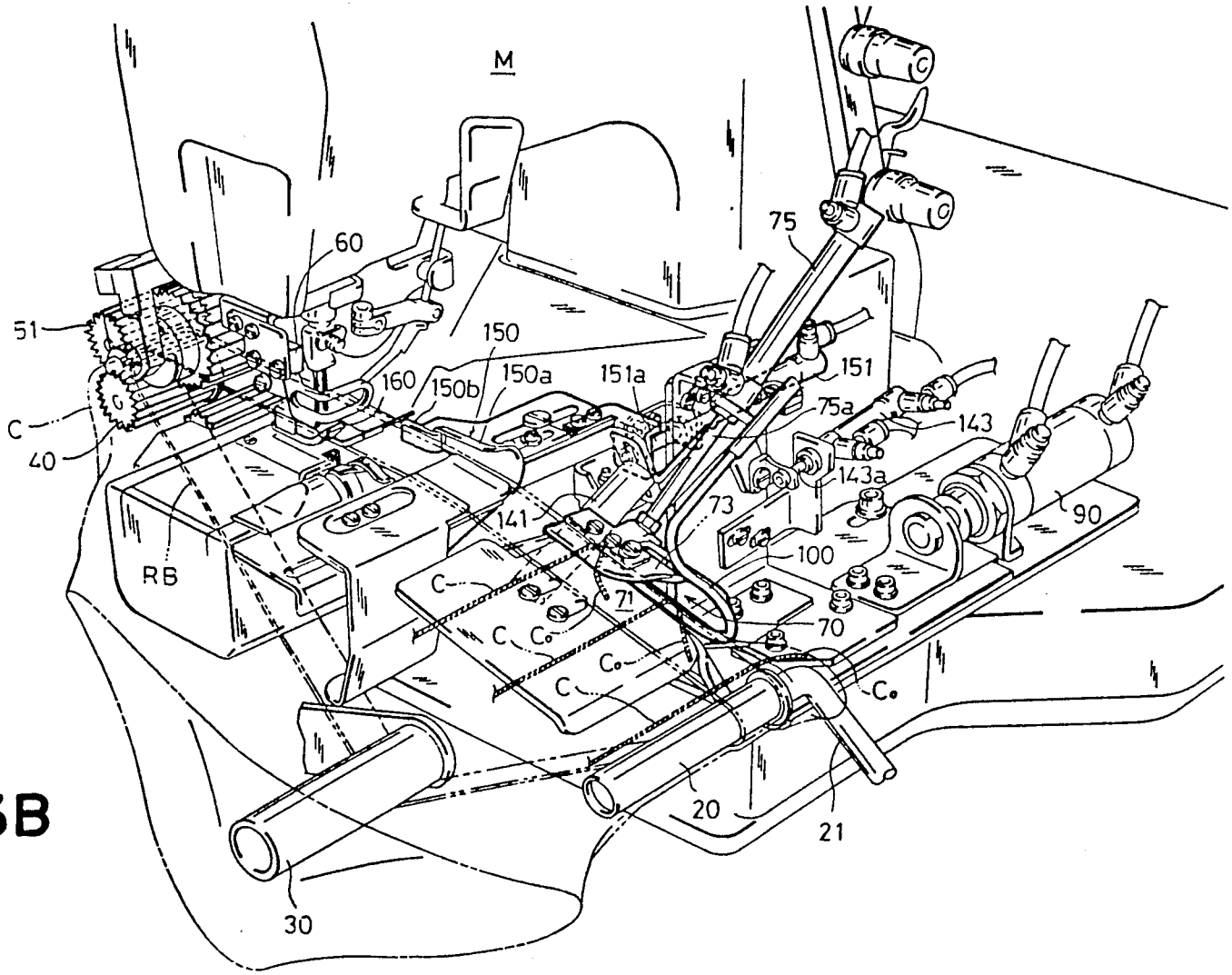

Next, on the waistband RB between the guide roller 20 and guide roller 40, the side portion of the cloth to receive this waistband RB in is overlaid. At this time, the cloth is arranged so that its edge may project beyond the right side of the right side edge of the waistband RB. The projecting width is generally known, for example, by putting a mark on the arm 21 of the guide roller 20. When the cloth is put on the waistband RB in this way, this cloth is detected by the cloth sensor 60, and the arm 52 of the forced feeding device 50 is tilted so that the feed roller 51 moves to the action position as shown in FIG. 3B. That is, the cloth C and waistband RB are held between the feed roller 51 and the guide roller 40. In the time chart shown in FIG. 5, the control box 181 causes the feed roller 51 to the action position in a specific time T1 after the cloth sensor 60 detects the cloth C.

In this state, for example, by operating a pedal switch, a folding command is issued. By this folding command, as shown in FIG. 3B, the third guide plane 73 of the cloth side portion folding guide 70 and the cloth guide 150 are moved to the action position. At the same time, air is ejected from the nozzle 101 at the front end of the air feed pipe 100, and the rotary drive source 54 of the forced feeding device 50 is operated. In the time chart shown in FIG. 5, when the folding command is issued from the control box 181, the third guide plane 73 is moved to the action position, and after preset time T2, the rotary drive source 54 is operated, and the air is ejected from the nozzle 101, and after preset time T4 ($T2<T4$), the cloth guide 150 is moved to the action position. The actuation of the rotary drive source 54 and ejection of air from the nozzle 101 are stopped by canceling the folding command. The third guide plane 73 and the cloth guide 150 are designed to remain in the action position even when the folding command is cleared. After once clearing the folding command, when it is issued again, the rotary drive source 54 is immediately put in action and air is ejected right away.

Figure 3C:
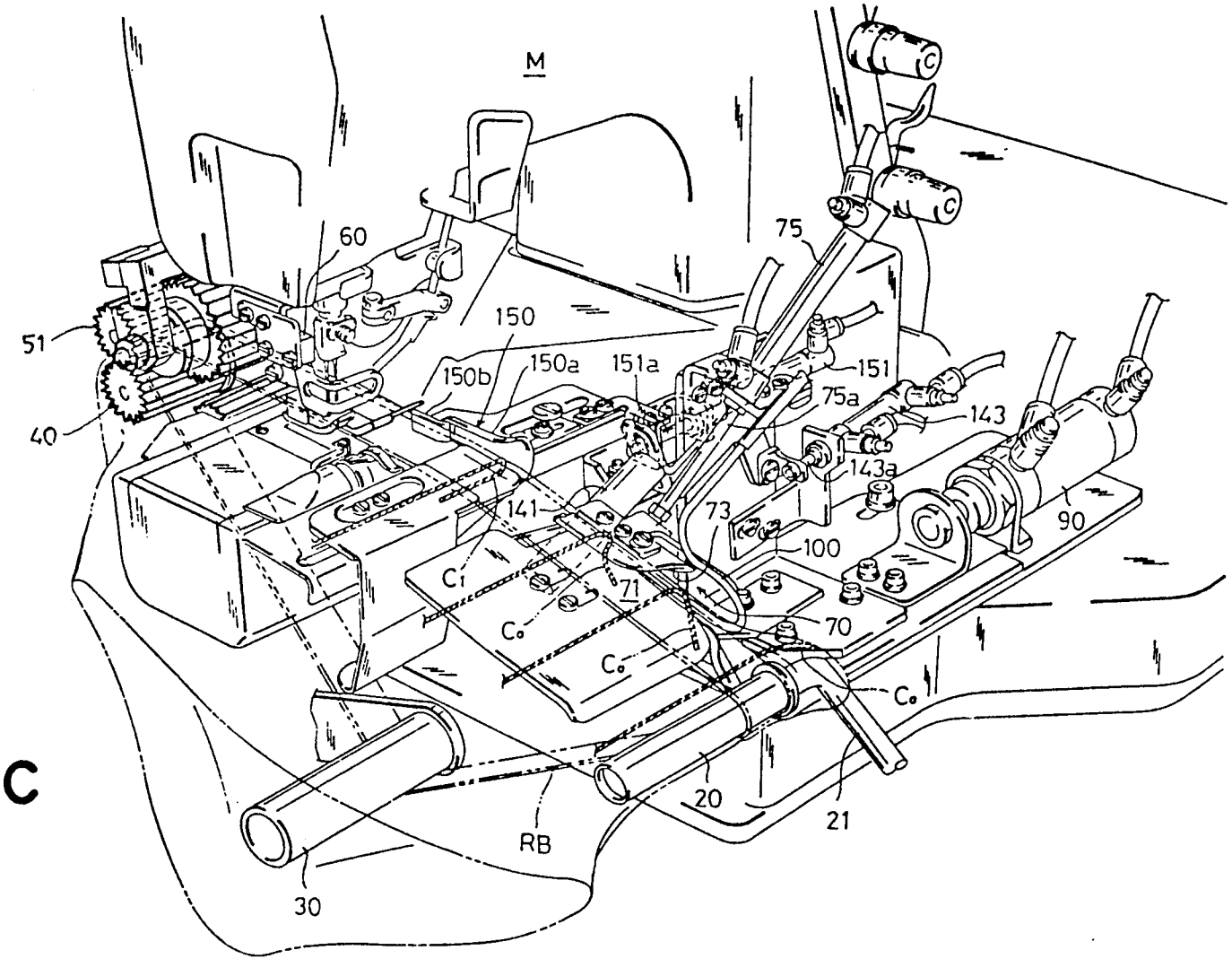

In this state, when the cloth C and waistband RB are fed in the cloth feed direction by the forced feeding device 50, as shown in FIG. 3B, the necessary width of the side portion Co of the cloth C is guided beneath the waistband RB by the action of the side portion folding guide 70 as mentioned above. The side portion Co of the cloth C guided beneath the waistband RB runs along the rear side of the waistband RB as the folding part Cl, as shown in FIG. 3C, by the action of the positioning guide 110 and cloth guide 150. By the air ejected from the nozzle 101 of the air feed pipe 100, even if the side end edge of cloth C is curled, it is corrected to a flat state.

Thus, the folding command is canceled after the side end portion of the cloth C ahead of the needle drop point 11 runs along beneath the waistband RB as folded portion Cl, and then the sewing machine switch is actuated to issue a sewing command to the sewing machine.

Figure 3D:
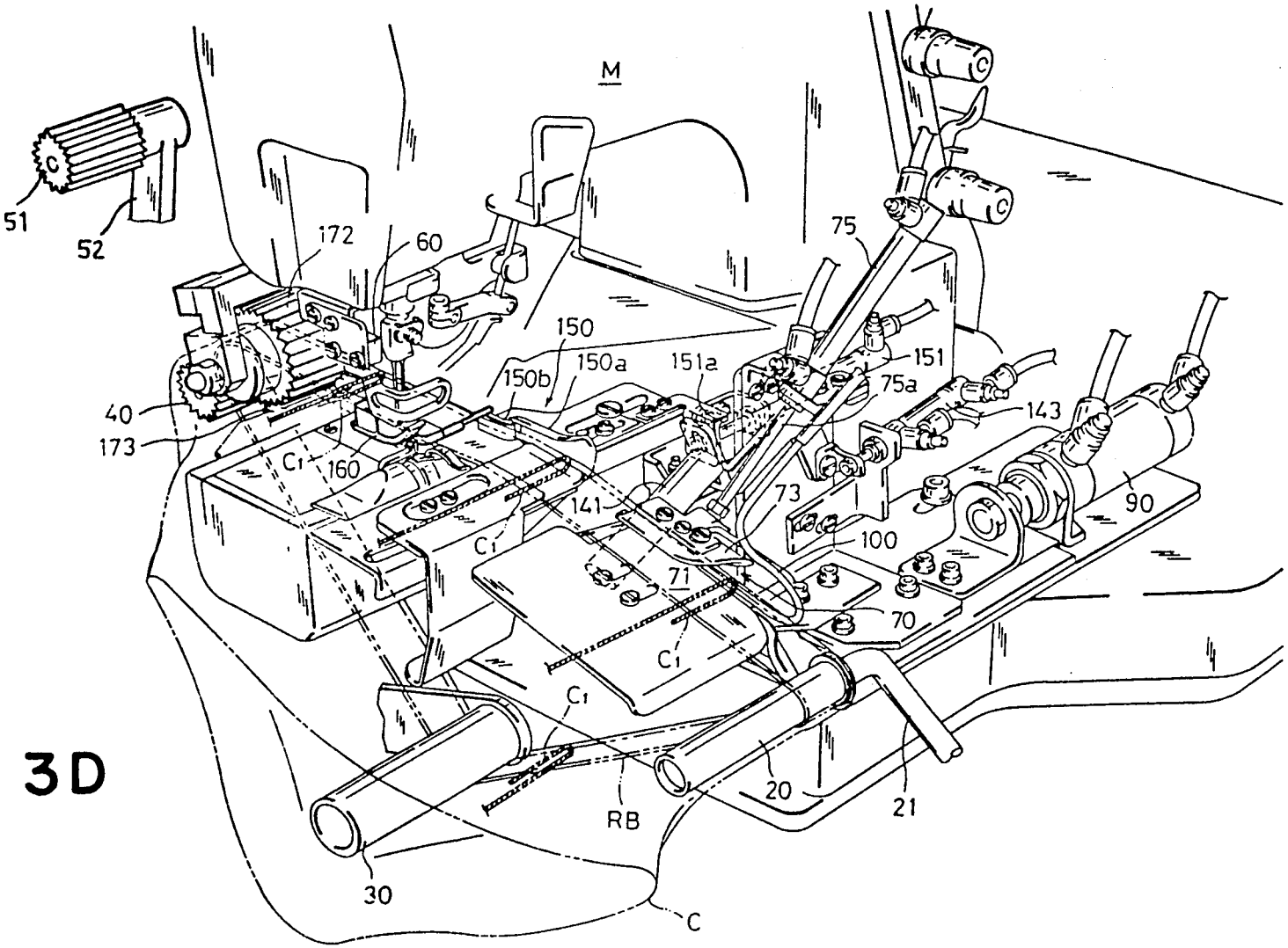
Figure 3E:
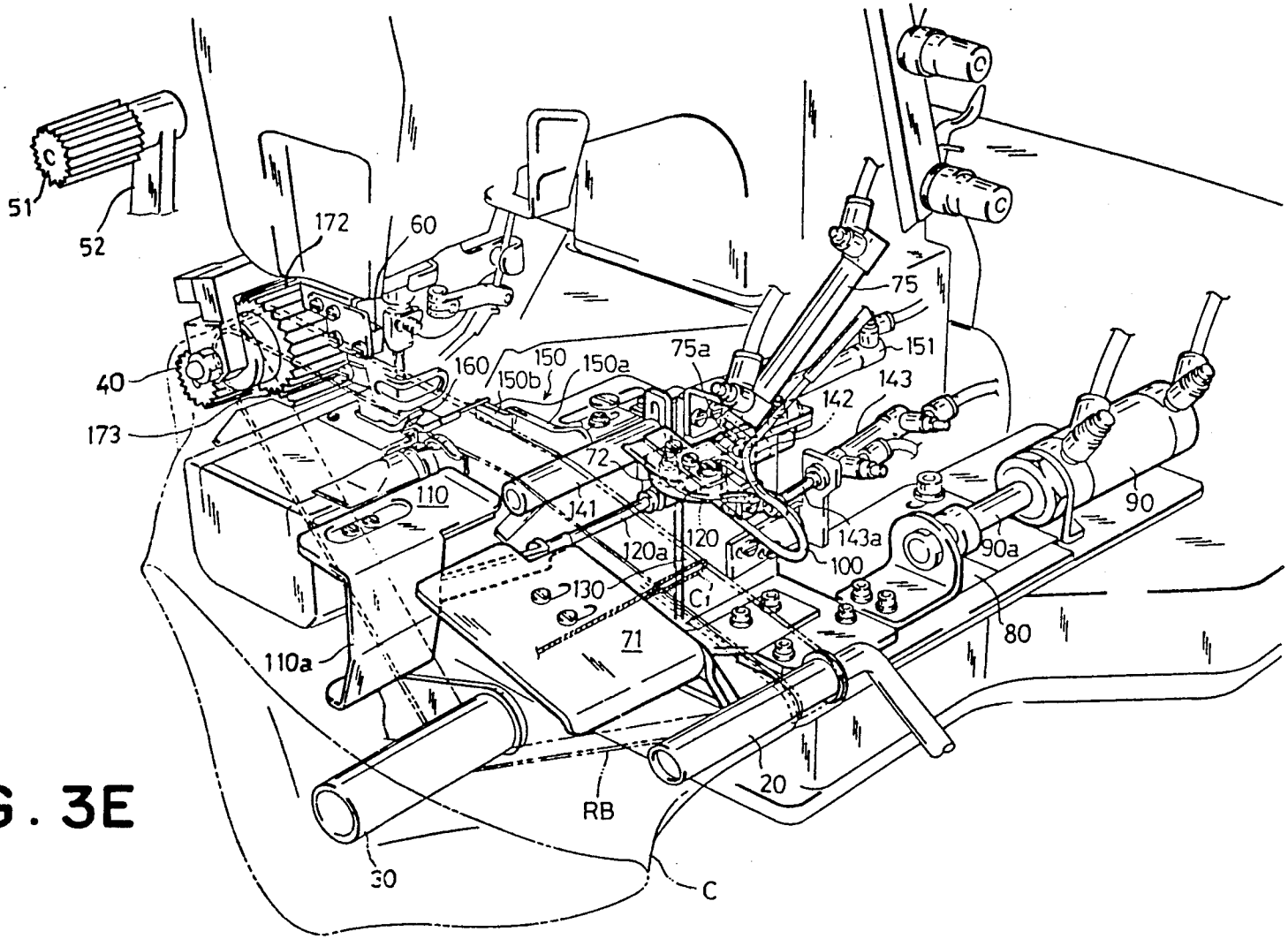

By this sewing command, as shown in FIG. 3D, the feed roller 51 of the forced feeding device 50 moves to the waiting position. At the same time, the presser foot 160 of the sewing machine descends to press down the cloth C, while the drive roller 172 of the forced feeding device 170 for sewing moves to the action position, and a rotation signal is given to the sewing machine motor 180. In the time chart in FIG. 5, after the sewing command is issued from the control box 181, immediately the feeding roller 51 moves to the waiting position, and after the preset time T7, the presser foot 160 and drive roller 172 descend, and after the preset time T8 (T7<T8), the sewing machine motor 180 is rotated to start sewing.

In this way, by inserting the waistband RB in the state as shown in FIG. 3D, when a sewing start part on the cloth C sequentially passes the guide rollers 40, 30, 20 to point ahead of the side portion folding guide 70, the air cylinder 90 and air cylinder 120 are put in action, and by extending the piston rods 90*a*, 120*a*, the first and second guide planes 71, 72 and positioning guide 110 escape to the waiting position as shown in FIG. 3E. As a result, the positioning guide 110 inserted between the waistband RB and the folded part Cl of the cloth C will not impede running of the cloth C, and the first and second guide planes 71, 72 will not interfere in running of the cloth. In the time chart in FIG. 5, when the number of stitches counted from the start of rotation of the sewing machine motor 180 reaches k0, it is known that the sewing start part has just come before the side portion folding guide 70, and according to this knowledge, the first and second guide planes 71, 72 and the positioning guide 110 are set aside in the waiting position.

In this way, simultaneously with or right after escaping the first guide plane 71 and others in the waiting position, as shown in FIG. 3E, the front end of the band lifting rod 141 which moves to the back side of the waistband RB along with this escape is elevated by actuating the air cylinder 143. In consequence, the waistband RB no longer guided by the positioning guide 110, is lifted up together with the folded portion Cl of the cloth C. In so doing, it is possible to prevent deviation of a sewing line on the cloth C to the right side due to lowering of only the side end portion side from the sewing position on the whole.

When the sewing is continued in the state in FIG. 3E and is terminated, the rotation of the sewing machine motor 180 is stopped, and the sewing thread is cut off, and the cloth C is detached off the sewing machine. In the time chart in FIG. 5, when the number of stitches counted from the start of rotation of the sewing machine motor 180 reaches k1, the rotation of the sewing machine motor 180 slows down, and in the preset time T9 after slow down, the thread cutting device (not shown) is actuated, and the thread is cut off during time Ta, and after preset time of Tb, the presser foot 160 and drive roller 172 are raised. Simultaneously with start of slow down of the sewing machine motor 180, ejection of air from the nozzle 101 of the air feed pipe 100 is stopped. In this state, by removing the cloth, the cloth sensor 60 no longer detects the cloth C, and hence the third guide plane 73 and cloth guide 150 escape at the waiting position, while the first and second guide planes 71, 72 and the positioning guide 110 are returned to the action position.

Thus, according to this device, only by setting the waistband RB in the band setting part, overlaying the cloth on specified position thereof and operating then the forced feeding device 50, the waistband RB may be inserted into the folded portion Cl of the cloth C, and the operator has only to put the cloth on the specified position, and is liberated from the manual tasks of winding the side portion of the cloth beneath the band, or guiding the cloth manually after start of sewing.

What is claimed is:

1. A waist part cloth guiding device for a sewing machine comprising:

a ring band setting part for setting a ring band around the bed of the sewing machine at a position passing close to the needle drop point of the sewing machine and extending in the direction of the cloth feeding direction of the sewing machine;

a forced feeding device for feeding the ring band in the cloth feeding direction regardless of the direction of operation of the main shaft of the sewing machine, together with a cloth to be folded at its side portion before sewing;

a cloth side portion folding guide disposed ahead of the needle drop point for folding the side portion of the cloth overlaid on the ring band beneath the ring band, said cloth side portion folding guide comprising;

a first guide plane which abuts the inner circumference of the ring band;

a second guide plane having a front end part located parallel to the cloth feeding direction and inside of the first guide plane and an upper side which is joined at an obtuse angle with the first guide plane and intersects with the inside end of the first guide plane beneath the first guide plane and is inclined downward and inward; and a third guide plane having a U-shaped section extending in a direction orthogonal to the cloth feeding direction which encloses the inside edge of the first guide plane at the point where the upper side of the second guide plane intersects with the inside edge of the first guide plane, wherein said third guide plane is moveable between an action position and a waiting position.

2. A waist part cloth guiding device for a sewing machine of claim 1, further comprising: a cloth guide located in the middle between said third guide plane and the needle drop point, said cloth guide moving between the action position and the waiting position for guiding the cloth along the inside end edge of the ring band set on the ring band setting part.

3. A waist part cloth guiding device for a sewing machine of claim 1, further comprising: a nozzle for blowing air to the side edge of the cloth guided beneath the first guide plane by the second and third guide planes, said nozzle being located at a position along the third guide plane.

4. A waist part cloth guiding device for a sewing machine according to claim 1, further comprising:

plural rod guides intersecting orthogonally with the cloth feed direction for winding the ring band, at least one of the rod guides being located behind the needle drop point and rotatable around an axis of rotation, wherein the forced feeding device comprises a feed roller moveable between an action position for holding the cloth and band and a waiting position retracted form the action position, a driving source for rotating this feed roller, and a sensor for detecting the presence of the cloth, whereby the feed roller is moved from the waiting position to the action position in response to the signal from the sensor and the feed roller is moved from the action position to the waiting position in response to the sewing command to the sewing machine.

5. A waist part cloth guiding device for a sewing machine according to claim 4, wherein:

the cloth side portion folding guide includes the third guide plane which moves from the waiting position to the action position in response to the drive command to a drive source of the forced feeding device and moves form the action position to the waiting position when the sensor detects that the cloth is removed from the sewing position; and the cloth guide moves from the waiting position to the action position in response to the drive command to the drive source of the forced feeding device, and moves from the action position to the waiting position when the sensor detects that the cloth is removed from the sewing position.

6. A waist part cloth guiding device for a sewing machine according to claim 4, wherein:

the cloth side portion folding guide includes the third guide plane which moves from the waiting position to the action position in response to the drive command to a drive source of the forced feeding device, and moves from the action position to the waiting position when the sensor detects that the cloth is removed from the sewing position; and the cloth guide moves from the waiting position to the action position in response to the drive command to the drive source of the forced feeding device, and moves from the action position to the waiting position when the sensor detects that the cloth is removed from the sewing position.

7. A waist part cloth guiding device for a sewing machine according to claim 1, further comprising:

a tongue-shaped positioning guide which is moveable between an action position abutting and lifting or supporting the rear side of the ring band set on the band setting part and a waiting position retracted from the action position to the outside of the sewing machine between the cloth side portion folding guide and the needle drop point, and moves from the action position to the waiting position when the beginning of the cloth has approached the near side of the needle drop point after starting sewing; and a lifting rod which lifts the ring band together with the side portion of the cloth folded to its rear side when the positioning guide is in the waiting position between the cloth side portion folding guide and the needle drop point.

8. A waist part cloth guiding device for a sewing machine according to claim 4, further comprising:

a tongue-shaped positioning guide which is moveable between an action position abutting and lifting or supporting the rear side of the ring band set on the band setting part and a waiting position retracted from the action position to the outside of the sewing machine between the cloth side portion folding guide and the needle drop point, and moves from the action position to the waiting position when the beginning of the cloth as approached the near side of the needle drop point after starting sewing; and a lifting rod which lifts the ring band together with the side portion of the cloth folded to its rear side when the positioning guide is in the waiting position between the cloth side portion folding guide and the needle drop point.

9. A waist part cloth guiding device for a sewing machine according to claim 2, further comprising:

a tongue-shaped positioning guide which is moveable between an action position abutting and lifting or supporting the rear side of the ring band set on the band setting part and a waiting position retracted from the action position to the outside of the sewing machine between the cloth side portion folding guide and the needle drop point, and moves from the action position to the waiting position when the beginning of the cloth has approached the near side of the needle drop point after starting sewing; and a lifting rod which lifts the ring band together with the side portion of the cloth folded to its rear side when the positioning guide is in the waiting position between the cloth side portion folding guide and the needle drop point.

10. A waist part cloth guiding device for a sewing machine comprising:

a cylindrical cloth setting part for setting a cylindrical cloth at a position passing through a needle drop point of the sewing machine with the periphery of the cylindrical cloth set in the cloth feeding direction of the sewing machine;

a forced feeding device for feeding the cylindrical cloth in the cloth feeding direction regardless of the direction of operation of the main shaft of the sewing machine; and a cloth side portion folding guide disposed ahead of the needle drop point for folding the side portion of the cylindrical cloth on the throat plate of the sewing machine, wherein the side portion folding guide comprises:

a first guide plane which abuts the inner circumference of the cylindrical cloth;

a second guide plane having a front end part located parallel to the cloth feeding direction and inside of the first guide plane, and an upper side which is joined at an obtuse angle with the first guide plane and intersects with the inside edge of the first guide plane beneath the first guide plane and is inclined downward and inward; and a third guide plane having a U-shaped section extending in a direction orthogonal to the cloth feeding direction, which encloses the inside edge of the first guide plane at the point where the upper side of the second guide plane intersects with the inside edge of the first guide plane, wherein said third guide plane is moveable between an action position and a waiting position not enclosing the inside edge.

11. A waist part cloth guiding device for a sewing machine according to claim 2, further comprising:

plural rod guides intersecting orthogonally with the cloth feed direction for winding the ring band, at least one of the rod guides being located behind the needle drop point and rotatable around an axis of rotation, wherein the forced feeding device comprises a feed roller moveable between an action position for holding the cloth and band and a waiting position retracted from the action position, a driving source for rotating this feed roller, and a sensor for detecting the presence of the cloth, whereby the feed roller is moved form the waiting position to the action position in response to the signal from the sensor and the feed roller is moved from the action position to the waiting position in response to the sewing command to the sewing machine.

12. A waist part cloth guiding device for a sewing machine according to claim 3, further comprising:

plural rod guides intersecting orthogonally with the cloth feed direction for winding the ring band, at least one of the rod guides being located behind the needle drop point and rotatable around an axis of rotation, the forced feeding device comprises a feed roller moveable between an action position for holding the cloth and band and a waiting position retracted from the action position, a driving source for rotating this feed roller; and a sensor for detecting the presence of the cloth, whereby the feed roller is moved from the waiting position to the action position in response to the signal from the sensor and the feed roller is moved form the action position to the waiting position in response to the sewing command to the sewing machine.

13. A waist part cloth guiding device for a sewing machine according to claim 11, wherein:

the cloth side portion folding guide includes the third guide plane which moves from the waiting position to the action position in response to the drive command to a drive source of the forced feeding device and moves from the action position to the waiting position when the sensor detects that the cloth is removed from the sewing position; and the cloth guide moves from the waiting position to the action position in response to the drive command to the drive source of the forced feeding device, and moves from the action position to the waiting position when the sensor detects that the cloth is removed from the sewing position.

14. A waist part cloth guiding device for a sewing machine according to claim 12, wherein:

the cloth side portion folding guide includes the third guide plane which moves from the waiting position to the action position in response to the drive command to a drive source of the forced feeding device and moves form the action position to the waiting position when the sensor detects that the cloth is removed from the sewing position; and the cloth guide moves from the waiting position to the action position in response to the drive command to the drive source of the forced feeding device, and moves from the action position to the waiting position when the sensor detects that the cloth is removed form the sewing position.

15. A waist part cloth guiding device for a sewing machine according to claim 11, further comprising:

a tongue-shaped positioning guide which is moveable between an action position abutting and lifting or supporting the rear side of the ring band set on the band setting part and a waiting position retracted from the action position to the outside of the sewing machine between the cloth side portion folding guide and the needle drop point, and moves from the action position to the waiting position when the beginning of the cloth has approached the near side of the needle drop point after starting sewing; and a lifting rod which lifts the ring band together with the side portion of the cloth folded to its rear side when the positioning guide is in the waiting position between the cloth side portion folding guide and the needle drop point.

16. A waist part cloth guiding device for a sewing machine of claim 12, further comprising:

a tongue-shaped positioning guide which is moveable between an action position abutting and lifting or supporting the rear side of the ring band set on the band setting part and a waiting position retracted from the action position to the outside of the sewing machine between the cloth side portion folding guide and the needle drop point, and moves from the action position to the waiting position when the beginning of the cloth has approached the near side of the needle drop point after starting sewing; and a lifting rod which lifts the ring band together with the side portion of the cloth folded to its rear side when the positioning guide is in the waiting position between the cloth side portion folding guide and the needle drop point.

* * * * *

UNITED STATES PATENT AND TRADEMARK OFFICE

CERTIFICATE OF CORRECTION

PATENT NO. : 5,131,336

DATED : July 21, 1992

INVENTOR(S) : Toshitaka Kono et al

It is certified that error appears in the above-identified patent and that said Letters Patent is hereby corrected as shown below:

Claim 4, column 10, line 64, "form" should be "from".

Claim 5, column 11, line 11, "form" should be "from".

Claim 8, column 11, line 62, "as" should be "has".

Claim 11, column 12, line 65, "form" should be "from".

Claim 12, column 13, line 18, "form" should be "from".

Claim 14, column 13, line 43, "form" should be "from".

Claim 14, column 14, line 8, "form" should be "from".

Signed and Sealed this

Seventeenth Day of August, 1993

Bruce Lehman

*Attest:*

BRUCE LEHMAN

*Attesting Officer*

*Commissioner of Patents and Trademarks*